US005651428A

United States Patent [19]

Ahigian et al.

[11] Patent Number: 5,651,428

[45] Date of Patent: Jul. 29, 1997

[54] STATIONARY ACTUATOR MOVING VANE ELEVATOR CAR DOOR COUPLING

[75] Inventors: Edward E. Ahigian, West Hartford; David W. Barrett, East Hartland; Thomas M. McHugh, Farmington; Jerome F. Jaminet, South Windsor; Thomas He, Unionville; Richard E. Peruggi, Glastonbury; Thomas M. Kowalczyk, Farmington; Richard E. Kulak, Bristol, all of Conn.

[73] Assignee: Otis Elevator Company, Farmington, Conn.

[21] Appl. No.: 599,860

[22] Filed: Feb. 13, 1996

Related U.S. Application Data

[63] Continuation of Ser. No. 225,220, Apr. 8, 1994, abandoned.

[51] Int. Cl.[6] ..... B66B 13/12

[52] U.S. Cl. ..... 187/330; 49/122

[58] Field of Search ..... 187/319, 330; 49/120, 122

[56] References Cited

U.S. PATENT DOCUMENTS 2,481,124 9/1949 Kruger ..... 187/319

3,783,977 1/1974 Voser ..... 187/319

4,947,964 8/1990 Husmann ..... 187/319

FOREIGN PATENT DOCUMENTS

A824928 2/1938 France .

*Primary Examiner*—Kenneth Noland

[57] ABSTRACT

A coupling for causing an elevator car door to engage an elevator hoistway door includes a pair of vanes, each end of each vane pivoted on a link connecting it with the other vane, the links being disposed for rotation between said two vanes on an elevator car door thereby forming a parallelogram. The vanes extend vertically between four rollers which rotate about horizontal axles disposed at the top of the hoistway door, and which provide rotationally stiff coupling. A solenoid actuator can move one vane up to cause the parallelogram to shrink, into an uncoupled position. When the actuator is disenergized, a spring causes the parallelogram to spread so that the vanes are wedged between the rollers and the two doors are coupled together.

11 Claims, 2 Drawing Sheets

STATIONARY ACTUATOR MOVING VANE ELEVATOR CAR DOOR COUPLING

This application is a continuation of application Ser. No. 08/225,220 filed on Apr. 8, 1994, now abandoned.

TECHNICAL FIELD

This invention relates to positively coupling the hoistway doors of an elevator to the elevator car doors for opening and closing in unison with and by the motion of the elevator car doors, without any electric actuator on the car doors, and without use of car door motion to engage the coupling.

BACKGROUND ART

Modern elevator systems have doors to permit transfer of passengers between the elevator cars and the respective floor landings. Because smaller doors have to travel a lesser distance and have less inertia, many elevators have two doors. They may meet in the middle, and thereby have a lesser distance to travel or they may both travel to the same side for opening. Other elevators may have only a single door. As used herein, the term "door" or "doors" may be used interchangeably, it being understood that there is no distinction between a single door and double doors concerning the subject matter hereof.

Present day elevator systems have doors mounted on the elevator car, and doors mounted at each hall landing of the elevator hoistway. The hoistway doors at the hall landings are mounted directly to the building structure, and are kept closed whenever the car is not present at the related landing in order to prevent passengers and objects from entering the hoistway. Instead of having door operators for each of the hoistway doors, the hoistway doors are typically opened by coupling them with the car doors, so that opening of the car doors will open the hoistway doors in unison therewith, thereby protecting passengers in the car from the building structure and protecting passengers at the landing from the hoistway.

The manner of coupling the doors together must take into account several factors. The doors usually begin to open just before the car reaches the landing (such as 10 or 15 centimeters therefrom), resulting in relative vertical motion between the elevator door and the hoistway door as the elevator approaches the landing. A similar constraint is that the car may be releveled after the doors are open, which also requires permissible relative vertical motion between the car doors and the hoistway doors. The hoistway doors may easily be pushed open by the elevator doors, but they must also become closed, either by being pulled (or pushed) toward the closed position by the elevator doors, or by some biasing in the closed direction. Biasing in the closed direction may take the form of a spring, a weight or a spirator. However, any bias in the closed direction must be overcome by the force exerted by the elevator doors during the opening process. Similarly, any perturbations in the bias during the opening process will in turn provide perturbation in the control algorithm for the elevator door opening system. Therefore, it is deemed preferable to have the hoistway doors opened and closed by the elevator doors, with only enough separate bias to satisfy automatic door closure required by safety codes.

A typical coupling device employs a rigid vane mounted on the car door which engages a rotatable pawl from the hoistway door, the pawl having rollers thereon so that the vane can travel upwardly or downwardly while engaging the pawl. Typically, there may be some lost motion between the two doors; that is, the car door must begin to open before it engages the pawl, unlocking the hoistway door, and commencing to push the hoistway door, through the pawl, in the open direction. When closing, the hoistway doors must be fully latched before the car door motion stops (before the car doors are fully closed). In some assemblies, the rollers move into contact with the vane before motion, and in others, the vane is expanded to contact the rollers before any motion. However, devices of this type are wear and adjustment sensitive and require frequent adjustments and replacements over the life span of an elevator system.

A moving vane coupler, shown in U.S. Pat. No. 5,005,673, includes two vanes on the car door that separate to become wedged between two rollers on the hoistway door; the separation is caused by motion of the car door, working against a fixed cam.

Whenever there is a change in the amount of force required to move an elevator car door, either because of lost motion between it and a hoistway door, or because of a change in the mechanism leverage and the like, perturbations of the electrical control system which is providing the motive force for the car door opening mechanism can result. This in turn can cause vibrations and other mechanical perturbations thus resulting in additional wear and noise. In fact, for door control mechanisms which have closed velocity loop electrical control systems, horizontally stiff coupling is required throughout the full range of door motion. For door couplings which have lost motion, that is, the two door sets are de-coupled during some range (between 1 and 3 centimeters) of car door motion, the hoistway doors must rely on a weight closer (or other biasing device) to fully close the hall doors. And, in very tall buildings, door closing (particularly at the lobby) can be erratic due to hoistway air pressure (called "windage" or "chimney effect"), unless the hoistway doors are closed positively.

Another desired feature is that the edges of the hoistway doors be flush with the edges of the car doors, as a consequence of being opened completely in unison.

Of course, any coupling mechanism located on a particular hoistway door must have complete clearance, for all of the apparatus, including the corresponding parts of a coupling device which are mounted on the car doors, so that elevators that are simply passing by landings do not run the risk of contact with the hoistway door coupling devices.

Another difficulty with elevator car doors is that should there be any electrical devices mounted on the car door, then there need be electrical wires having an extremely high number of flexure cycles over a relatively short period of time, requiring additional maintenance.

DISCLOSURE OF INVENTION

Objects of the invention include provision of a coupling between an elevator car door and a hoistway door which allows relative vertical motion between the car door and the hall door when coupled, which provides the coupling throughout the full range of door motion (not operated by door motion), and which requires no electrical power on the elevator door.

According to the present invention, relative motion between a pair of bumpers, such as rollers, and a pair of vanes disposed between a hoistway door and the door of an elevator car within the landing zone of the floor landing of the hoistway door, are moved relative to each other so that the bumpers engage the vanes thereby rigidly coupling said doors together to be opened and closed in unison, and relative motion between the rollers and the vanes cause the rollers to disengage the vanes and to provide uncoupled clearance between the rollers and the vanes, the relative motion being provided by means including an electrically operated actuator disposed in fixed relationship on the elevator car, and not moving with the elevator car door, whereby electrical power is not required on the elevator car door.

According to the invention in one form, a pair of vanes disposed on an elevator car door are forced apart so as to become wedged between rollers extending outwardly from an elevator hoistway door into the hoistway, at a landing where the elevator car is making a stop, thereby coupling the doors together, or are forced together into an uncoupled position, by a solenoid actuator mounted in a fixed relationship to an elevator car pushing vertically on one of them against a spring that opposes the actuator.

The vanes readily slide vertically along the rollers, due to the rollers comprising low friction slide surfaces or rollers, thereby allowing advance door opening (commencing to open the door just before the elevator reaches the landing), and releveling of the elevator, even after the doors are fully open. According to the invention, the actuator is disposed on the elevator car, rather than on the elevator car door; the actuator allows the vanes to move horizontally, with respect to the elevator car, even though the actuator does not move with respect to the car. There is therefore no need for an electric wire going from the elevator car to the elevator car door. This is an important improvement in elevator car door couplings.

In the disclosed embodiment, the actuator is a solenoid actuator, though it can be any actuator capable of providing the desired motion, without relying on door motion as a source of power. The invention is disclosed in a configuration in which the solenoid raises one of the vanes, thereby drawing the vanes together into an uncoupled position. When the solenoid is not operated, a spring causes the two vanes to separate into the coupled position. However, the solenoid or other actuator could push up or down on the same or the other vane to achieve the same operation, or to cause the vanes to be forced apart into the coupled position, while allowing some other mechanism, such as a spring, draw the vanes together into the uncoupled position.

The invention may also be used in an embodiment where fixed vanes are disposed on the hoistway door and movable bumpers, such as rollers, are disposed on the elevator car door, and caused to transfer between a coupled position and an uncoupled position by means of an actuator disposed in fixed relationship on the elevator car, with any suitable linkage.

The present invention has been disclosed in an embodiment in which movable vanes are expanded to make contact with relatively fixed rollers. In the present embodiment, the movable vanes are disposed on the elevator car door and the relatively fixed rollers are disposed on the hoistway door. However, the invention may also be practiced in an embodiment which utilizes fixed vanes and movable rollers. The invention may be practiced utilizing movable rollers on an elevator car door which become coupled to vanes which are fixed on a hoistway door. In fact, an actuator disposed in fixed relationship on an elevator car may be used to move rollers which are mounted on an elevator car door in a fashion to be movable from an uncoupled, clearance position to a coupled position, and vice versa, such as the rollers 12, 13 and fixed vanes 8, 9 disclosed in a commonly owned, copending application entitled "Rotary Elevator Car Door Coupling", Ser. No. (OT-2031) filed on Apr. 6, 1994 by the inventors hereof. To do so would require only removal of the electric actuator 18 from the car door, and substituting therefor a suitable actuator on the elevator car together with correct linkages and the like, all of which is obvious in view of the teachings herein and therein. In a similar fashion, relatively movable rollers and vanes, regardless of on which door either of them are disposed, may be operated in accordance with the invention by an actuator disposed in fixed relationship on the elevator car.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
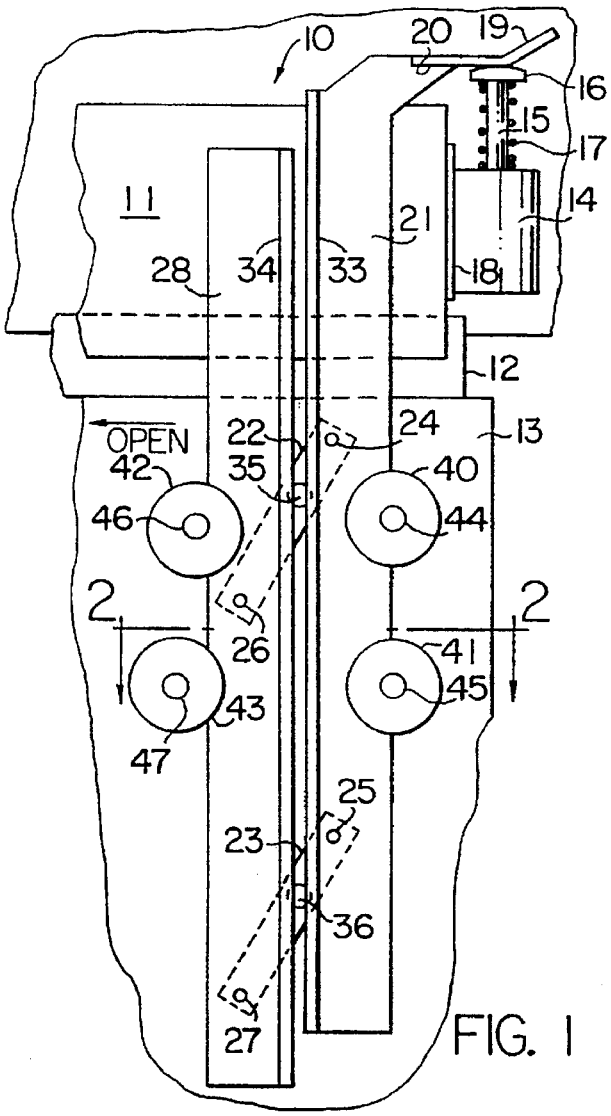
FIG. 1 is a partial, front elevation view taken on the line 1—1 of FIG. 2 of a door coupler of the invention on an elevator car door, in the uncoupled position.
Figure 2:
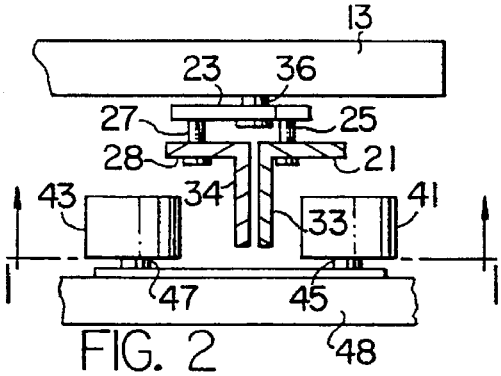
FIG. 2 is a partial, partially sectioned top plan view taken on the line 2—2 of FIG. 1, showing the coupler in the uncoupled position.
Figure 3:
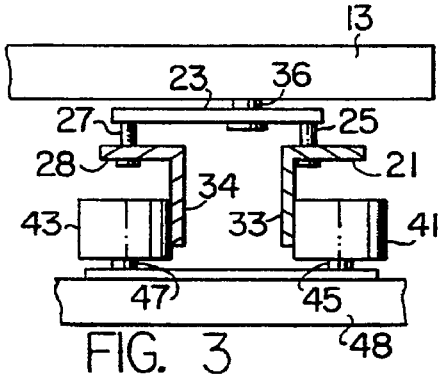
FIG. 3 is a top plan view, partially sectioned, similar to FIG. 2 but showing the coupler in the coupled position.

Referring now to FIG. 1, an elevator car 10 has a linear induction motor 11 disposed thereon so as to operate a secondary 12 thereof which is secured in some fashion to an elevator car door 13 so as to cause the door to open and close, in response to suitable demand. The door 13 is shown in its fully closed position, and actuation of the linear induction motor 11, 12 will cause the door to move toward the left as seen in FIG. 1, into the open position. Attached to the primary 11 of the motor is a solenoid actuator 14, the armature 15 of which is connected to a cap 16 which is normally forced upward (in FIG. 1) by a spring 17. With the cap 16 in the position shown in FIG. 1, it is in contact with a shelf 20 on an angle 21 which is disposed to a pair of links 22, 23 by corresponding pivots 24, 25. The other end of each link 22, 23 is connected by pivots 26, 27 to another angle 28. The angles 21 and 28 (as seen in FIGS. 2 and 3) in this embodiment may be angles with about equal legs. The solenoid actuator 14 is mounted on a bracket 18 that brings it forward of the front edge of the motor primary 11; the shelf 20 similarly extends forward of the angle 21. The shelf 20 is bent to form a ramp 19. The legs, shown edgewise in FIG. 1, comprise substantially vertically disposed parallel vanes 33, 34. Each link 22, 23 is disposed by a corresponding pivot 35, 36 to the elevator car door 13.

Figure 4:
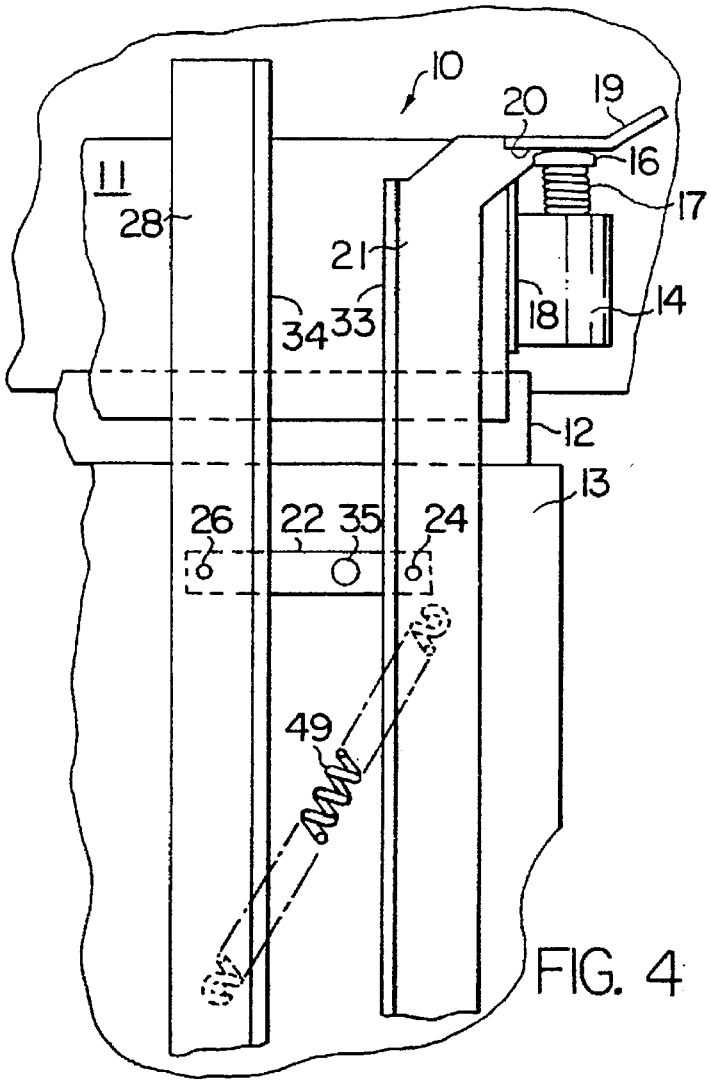
FIG. 4 is a partial, front elevation view of the apparatus of FIG. 1 in the coupled position.

Downward actuation of the solenoid actuator 14 as seen in FIG. 4, will allow the links 28, 23 to rotate about the pivots 35, 36 causing the vane 33 to be lowered and the vane 34 to be raised, into the positions shown in FIG. 4. This will cause the vanes 33, 34 to be wedged (FIG. 3) between a plurality of rollers, such as rollers 40–43, which are mounted by corresponding axles 44–47 on an elevator hoistway door 48. The movement of the solenoid actuator 14 may, if desired, be chosen to lower the vane 33 and raise the vane 34 sufficiently so that the links 22, 23 will be rotated just past the position at which the two vanes 33, 34 are at the maximal distance from each other, as shown in FIG. 4. This can be achieved by a tension spring 49, shown for convenience only in FIG. 4, which is attached to the car door side of the angles 21, 28 (the back in FIG. 4). With the links 22, 23 in the position shown in FIG. 4, there is no chance that the two arms will resume the uncoupled position shown in FIGS. 1 and 2 as a consequence of vibration and other mechanical shock resulting from the opening of the car door. The force required to open or close the doors is transmitted horizontally through the links 22, 23 and therefore does not tend to close the parallelogram.

When the car door 13 opens, by traveling to the left as seen in FIGS. 1–4, the shelf 20 will simply slide away from the bracket 16. Car door motion has no effect on the positioning of the blades 33, 34. The solenoid 14 may remain in an energized condition, with the shelf 20 in a fully lowered position (as in FIG. 4), so that the shelf 20 can slide back above it when the elevator door 13 is closed. Then, the solenoid 14 can be disenergized so the spring 17 will raise the shelf 20 and pull the angle 21 upwardly to the position shown in FIG. 1, thereby restoring the vanes 33, 34 into the uncoupled position shown in FIGS. 1 and 2. This provides clearance so that the elevator may travel upwardly and downwardly in the hoistway without contacting any of the rollers 40–43 (or similar rollers on other hoistway doors in the same elevator hoistway). The actuator 14 may be rotary or of some other configuration, so long as it can open the vanes without door motion. The nature of all of the details of the actuator 14, the ramp 19 and the surface 20 is a function of the particular installation in which the invention may be practiced.

In the disclosed embodiment, the rollers comprise four rollers 40–43 arranged in pairs, each roller of a pair 40, 42, when coupled, being disposed essentially vertically above the other roller of the pair 41, 43, respectively. This provides the greatest degree of horizontal stiffness as well as rotational stiffness, thereby enhancing the ability of the linear induction motor 11, 12 to provide smooth, quiet motion to the car door 13 and the hoistway door 48. Of course, the vanes 33, 34 need not be perfectly parallel to each other nor absolutely vertical; it suffice that the vanes can be wedged between suitable rollers so as to provide horizontal and rotational stiffness between the elevator car door 13 and the hoistway door 48, as described.

The bumpers are preferably rollers 40, 43 disposed for rotation on corresponding axles 44–47 so as to permit relative vertical motion between the elevator car door 13 and the hoistway door 48 during advance door opening and, even after the door is opened, releveling of the elevator, as is known. However, instead of rollers 40–43, suitable self-lubricating bumpers, such as might be made of delrin or nylon, may be used if desired. The links 22, 23 are shown and described as being near the ends of the vanes 33, 34; however, that is deemed herein to include any suitable spacing along the vanes. The vanes are disposed to the links by the pivots on the other legs of the angles.

Figure 5:
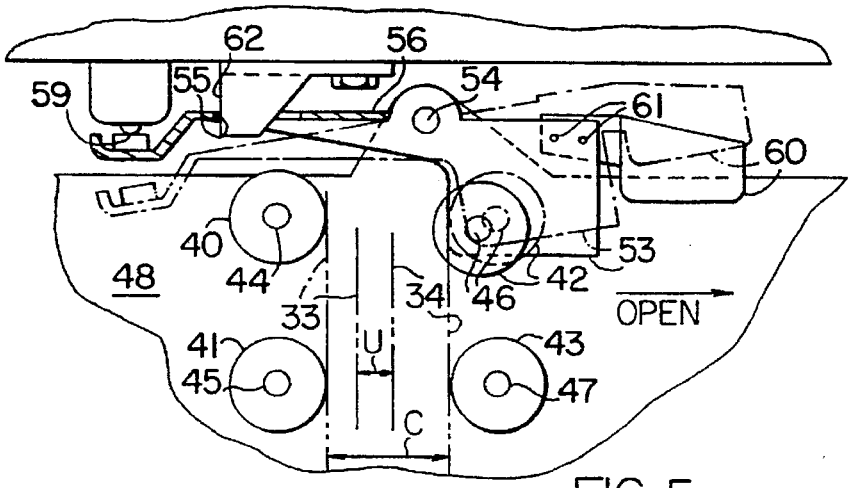
FIG. 5 is a simplified, partial, partially sectioned rear elevation view of the rollers shown in FIG. 1, being a front elevation view of the apparatus disposed on a hoistway door.

Referring now to FIG. 5, the rollers 40–43 are being viewed oppositely to the view of them in FIG. 1. In FIG. 1, the view is toward the elevator car door, whereas in FIG. 5 the view is toward the hoistway door. In FIG. 5, the axle 46 is disposed for rotation on a switch/lock plate 53 which is rotatable about a pivot 54 in response to the vane 34 moving from the uncoupled position of FIGS. 1 and 2 into the coupled position of FIGS. 3 and 4. The pivot 54 is connected to the hoistway door 48. The resulting position of the switch/lock plate 53 is shown in dotted lines in FIG. 5. The switch/lock plate 53 has a lip 55 formed in a shelf 56 thereof, the shelf 56 extending outwardly to a point where it makes electrical contact between the safety switch contacts 59, in a well-known way. The plate 53 has a small weight 60 fastened thereto in any suitable way such as by rivets 61. The weight 60 ensures that the lip 55 will engage a latch 62 whenever the hoistway door 48 is moved to the closed position as shown in FIG. 5.

Figure 6:
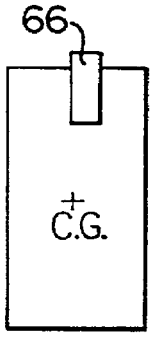
FIG. 6 is a simple illustration of the location of a door coupler in accordance with the invention.

When the armature 14 is actuated, just prior to door opening, the spring 49 is compressed as seen in FIG. 4 and the spring 49 will cause the vanes 33, 34 to spread, thereby moving the roller 42 to the right as seen in FIG. 5, causing the plate 53 to rotate counterclockwise about the pivot 54 against the gravitational force of the weight 60. The action of the roller 42, the plate 53, the lip and latch 55, 62 and safety switch contacts 59 are all as is known in the prior art. However, in the prior art, only two rollers 40, 42 are utilized to couple the elevator car door to the hoistway door. In the prior art, the coupling device was mounted near the center of gravity (C.G., FIG. 6) or immediately above it. In FIG. 6, the coupler 66 of the present invention is mounted at the top of the hoistway door, above the center of gravity. The combination of mounting the coupler at the top of the hoistway door, vertically as near as possible to the point at which motion is imparted to the elevator car door by the linear motor 11, 12, together with providing the additional rollers 41, 43 for rotational stiffness (in addition to the lateral stiffness provided by only a single pair of rollers 40, 42) is shown to significantly reduce rocking of the doors as they are opened or closed, thereby eliminating noise and eliminating perturbations in the drive system for the linear motor 11, 12.

The spring 49 is shown schematically, only in FIG. 4, because it is a well known expedient. Other means of causing the vanes to spread apart as seen in FIG. 4 may be used if desired without departing from the invention herein. In FIGS. 1 and 4, it can be seen that the distance between the pivot 24 and the pivot 35 is one-half as great as the distance between the pivot 26 and the pivot 35. This is a known expedient that assists in moving the roller 42 (FIG. 5) so as to ensure that the hoistway door is unlatched before the car door begins to move it.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. Apparatus for coupling an elevator hoistway door to an elevator car door so that the two may be operated in unison, comprising:

a pair of bumpers extending outwardly into the hoistway from a surface of a hoistway door, each bumper being horizontally displaced from but in proximity with the other of said bumpers; and a pair of vanes, a first end of each of said vanes being pivotally connected to a corresponding end of a first link, a second end of each of said vanes being pivotally connected to a proximate end of the other of said vanes by a second link, one of said links being substantially vertically disposed apart from but in proximity with the other of said links on a surface of said elevator car door facing said hoistway door, each of said links being pivoted, between the connections to the corresponding vanes, for rotation about a generally horizontal axis perpendicular to the plane of said surface of the elevator car door, whereby said vanes and said links form a parallelogram;

characterized by the improvement comprising:

an electrically operated actuator disposed on the elevator car above said door and in contact, when said door is closed, with one of said vanes, operation of said actuator in one vertical direction applying a vertical force and moving said one vane in a first vertical direction and disenergizing operation of said actuator in said one vertical direction allowing said one vane to move in a second vertical direction, the vertical motion of said one vane in one direction being accompanied, as a consequence of said pivoted links, with horizontal motion of said one vane away from the other one of said vanes, and causing a corresponding horizontal motion of said other vane away from said one vane, whereby vertical actuation of said actuator controls causing said vanes to separate sufficiently so as to become wedged between said bumpers thereby coupling said hoistway door to said car door, and causing said vanes to draw together into an uncoupled position; and wherein said actuator comprises a bracket for engaging one of said vanes when the elevator door is closed, thereby enabling said actuator to raise or lower said one vane to thereby cause said vanes to assume a coupled or uncoupled position, said bracket configured to allow said vane to disengage from said bracket as said elevator door is moved into an open position.

2. Apparatus according to claim 1 wherein said bumpers are rollers disposed for rotation about horizontal axles disposed on said hoistway door.

3. Apparatus according to claim 1 wherein said actuator is a solenoid actuator.

4. Apparatus according to claim 3 wherein said solenoid actuator is disposed with its armature vertical.

5. Apparatus according to claim 1 wherein said actuator forces said one vane up.

6. Apparatus according to claim 1 wherein operation of said actuator forces said vanes to draw together into said uncoupled position.

7. Apparatus according to claim 1 including a second pair of bumpers, each disposed to engage one of said vanes when said vanes are separated into said coupled position.

8. Apparatus for coupling an elevator hoistway door to an elevator car door so that the two may be operated in unison, comprising:

a first set including a pair of vanes between said doors when said elevator car is within a landing zone of a floor landing;

a second set including a pair of bumpers between said doors when said elevator car is within a landing zone of a floor landing, one of said sets disposed on said elevator car door and the other of said sets disposed on the hoistway door of said landing; and means including an electrically operated actuator disposed in fixed relationship on said elevator car for causing relative motion between said bumpers and said vanes so as to cause said bumpers to rigidly engage said vanes, thereby coupling said doors together to be opened and closed in unison, and for causing relative motion between said bumpers and said vanes so as to cause said bumpers to disengage said vanes and provide uncoupled clearance between said bumpers and said vanes;

wherein the improvement comprises:

said means being disposed on said car above said door; and said actuator comprising a bracket for engaging, when said elevator car door is closed, the one of said sets disposed on said elevator car door, thereby enabling said actuator to cause relative motion between said bumpers and said vanes, said bracket configured to allow said one of said sets disposed on said elevator car door to disengage from said bracket as said elevator door is moved into an open position.

9. Apparatus according to claim 8 wherein said bumpers are rollers disposed for rotation about horizontal axles disposed on said hoistway door.

10. Apparatus according to claim 8 wherein said actuator is a solenoid actuator.

11. Apparatus according to claim 8 wherein said vanes are disposed on said elevator car door.

* * * * *